US006041973A

United States Patent [19]

Bailey

[11] Patent Number: 6,041,973

[45] Date of Patent: Mar. 28, 2000

[54] PORTABLE APPLICATOR FOR FLOWABLE MATERIALS

[75] Inventor: Patrick Warren Bailey, Cherry Burton, United Kingdom

[73] Assignee: Rhone-Poulenc Agriculture, Ltd., United Kingdom

[21] Appl. No.: 09/021,724

[22] Filed: Feb. 11, 1998

[30] Foreign Application Priority Data

Feb. 12, 1997 [GB] United Kingdom ..... 9702851

[51] Int. Cl.[7] ..... B67D 5/64

[52] U.S. Cl. ..... 222/175; 222/529; 222/555

[58] Field of Search ..... 222/556, 529, 222/555, 175; 239/154

[56] References Cited

U.S. PATENT DOCUMENTS

| | | | |
|---|---|---|---|
| 2,549,233 | 4/1951 | Phillips | 222/175 |
| 2,795,080 | 6/1957 | Williams | 222/175 |
| 4,322,017 | 3/1982 | Lowdermilk . | |
| 5,020,702 | 6/1991 | James | 222/529 |
| 5,046,448 | 9/1991 | Crisafulli | 222/175 |
| 5,123,574 | 6/1992 | Poulos . | |
| 5,289,945 | 3/1994 | Stradder . | |
| 5,335,853 | 8/1994 | Wirz | 222/175 |
| 5,358,132 | 10/1994 | Bennett . | |

FOREIGN PATENT DOCUMENTS

| | | |
|---|---|---|
| 0 389 919 | 10/1990 | European Pat. Off. . |
| 0 549 065 | 6/1993 | European Pat. Off. . |
| 0 685 155 | 12/1995 | European Pat. Off. . |
| 2 600 559 | 6/1986 | France . |
| 7-275753 | 10/1995 | Japan . |
| 7275753 | 10/1995 | Japan . |
| 215597 | 5/1924 | United Kingdom . |
| 368119 | 3/1932 | United Kingdom . |
| 436583 | 10/1935 | United Kingdom . |
| 507135 | 6/1939 | United Kingdom . |
| 2 159 381 | 5/1985 | United Kingdom . |

OTHER PUBLICATIONS

EPO Search Report No. RS 98330 GB dated Oct. 10, 1997.

*Primary Examiner*—P. Derakshani
*Attorney, Agent, or Firm*—Jenkins & Wilson, P.A.

[57] ABSTRACT

A portable applicator for dispensing flowable material from a container, the applicator comprising a carrying frame for wearing by a user and for supporting a container such that a valve of the container faces substantially downwardly; an inlet mounted to said carrying frame for sealable engagement with a valve of a container for receiving material from the container when the valve thereof is in an open condition thereof; and a dispenser outlet communicating with said inlet for dispensing material received via said inlet.

18 Claims, 2 Drawing Sheets

PORTABLE APPLICATOR FOR FLOWABLE MATERIALS

TECHNICAL FIELD

The present invention relates generally to an applicator for dispensing flowable material from a container. The invention relates particularly, but not exclusively, to a portable applicator for dispensing agricultural chemicals such as pesticides.

BACKGROUND ART

In view of the potentially hazardous nature of many agricultural chemicals such as insecticides, it is desirable to minimize the potential exposure of personnel to such chemicals. European Patent Application No. 0 685 155 discloses a valve device for connecting a container filled with flowable material to an applicator device for dispensing the flowable material. The valve device has a housing connected in use to the outlet of a container of flowable material and a valve member connected to the inlet of a hopper forming part of the applicator device. Relative movement between the housing and the valve member then enables the flowable material to pass from the container to the hopper.

Although valve devices of this type serve to minimize exposure of personnel to the flowable material in question, such devices have hitherto only been used in applications in which the applicator device is mounted to a tractor. However, in many areas of the world, particularly in third world countries, tractor mounted applicator devices are unsuitable. For example, tractors may be unavailable for economic reasons, or unusable for reasons of uneven terrain, or the particular agricultural activity involved, such as on banana plantations where the random growth of banana plants prevents the arrangement of the plants in rows between which a tractor can pass.

In such cases, it is generally the practice to dispense agricultural chemicals from a portable backpack applicator. Such applicators generally have a refillable reservoir for flowable material which is filled from a (usually larger) container or bag of flowable material. However, in many third world countries, there is the potential hazard of the empty container being re-used in an unsuitable manner, such as the storage of drinking water or, especially in the case of bags, the hazard of disposal by incineration with the accompanying environmental hazards.

DISCLOSURE OF THE INVENTION

Preferred embodiments of the present invention therefore seek to overcome the above disadvantages of the prior art.

According to an aspect of the present invention, there is provided a portable applicator for dispensing flowable material from a container, the applicator comprising:

- a carrying frame for wearing by a user and for supporting a container such that a valve of the container faces substantially downwardly;
- an inlet mounted to said carrying frame for sealable engagement with a valve of a container for receiving material from the container when the valve thereof is in an open condition thereof; and
- a dispenser outlet communicating with said inlet for dispensing material received via said inlet.

By providing an applicator not having an integral reservoir for flowable material and in which the reservoir is provided by the container of flowable material, this has the advantage of enabling the material supplier to provide a container which is refillable by the supplier. This reduces the potential for use of the container for other purposes or of inappropriate destruction of the container. In addition, the provision of a container having a valve cooperating with the inlet of the applicator reduces potentially hazardous exposure of personnel to the flowable material.

The applicator preferably further comprises a stand portion for enabling the applicator to stand upright when not worn by a user.

In preferred embodiment, the applicator further comprises a first support portion for supporting the inlet.

The first support portion advantageously comprises a support bracket connected to said inlet and pivotably mounted to said carrying frame.

This provides the advantage of enabling the applicator to be constructed in such a manner that the support bracket can be pivoted between a first position relative to the frame such that a container can be conveniently mounted to the applicator, and a second position in which the container is supported vertically above the inlet. This minimizes torsional or shear force which may otherwise tend to damage the valve of the container.

The applicator may further comprise restraining means for restraining pivotal movement of said support bracket relative to said carrying frame in use.

This provides the advantage of enabling the container to be secured in position in which it is supported vertically above the inlet.

The restraining means may comprise a strap for mounting a container in position against the carrying frame.

In a preferred embodiment, the applicator further comprises a second support portion for supporting the container in use.

This has the advantage of minimizing the amount of stress on each support of the container.

The second support portion may comprise a support bracket mounted to an upright portion of the carrying frame.

The applicator preferably further comprises a container comprising at least one valve having an open condition in which material can pass from the container into the inlet and a closed condition in which the valve is sealed, wherein the or each valve is in its open condition when the container is mounted to the inlet and in its closed condition when the container is disengaged from the inlet.

By providing the valve on the replaceable container as opposed to the permanent components of the applicator, this provides the advantage that if damage to the valve should occur, the damage can be remedied by replacement of only the container, rather than the applicator as a whole.

Advantageously, the container comprises a first valve, and a second valve communicating therewith such that movement of the first valve between its open and closed conditions causes movement of the second valve between its open and closed conditions to enable flow of material through said first and second valves.

The dispenser outlet may comprise an input port for communication with a container of flowable material;

- an output port for dispensing flowable material therefrom; and
- a dispensing lever having a chamber therein for receiving flowable material, wherein the lever is movable between a first position in which said chamber is in communication with the output port to enable a quantity of flowable material to be dispensed therefrom and a second position in which said material is prevented from being dispensed from the output port.

In a preferred embodiment, the inlet and outlet ports are not aligned and said chamber communicates with said inlet port when the lever is in said second position.

Alternatively, the inlet and outlet ports may be substantially aligned and material can flow continuously from said inlet port to said outlet port when the lever is in said first position.

In a preferred embodiment, the outlet further comprises means for adjusting the volume of said chamber.

The volume adjusting means may comprise a plurality of inserts adapted to be received in the chamber for reducing the volume thereof.

Alternatively, or in addition, the volume adjusting means may comprise a plurality of said levers of different thicknesses, wherein the levers are interchangeably mountable to the outlet.

According to another aspect of the invention, there is provided a dispenser outlet for dispensing flowable material, the outlet comprising:

an input port for communication with a container of flowable material;

an output port for dispensing flowable material therefrom; and a dispensing lever having a chamber therein for receiving flowable material, wherein the lever is movable between a first position in which said chamber is in communication with the output port to enable a quantity of flowable material to be dispensed therefrom and a second position in which said material is prevented from being dispensed from the output port.

In a preferred embodiment, the inlet and outlet ports are not aligned and said chamber communicates with said inlet port when the lever is in said second position.

The inlet and outlet ports may be substantially aligned and material may flow continuously from said inlet port to said outlet port when the lever is in said first position.

The outlet advantageously further comprises means for adjusting the volume of said chamber.

The volume adjusting means may comprise a plurality of inserts adapted to be received in the chamber for reducing the volume thereof.

Alternatively, the volume adjusting means may comprise a plurality of said levers of different thicknesses, wherein the levers are interchangeably mountable to the outlet.

BRIEF DESCRIPTION OF THE DRAWINGS

As an aid to understanding of the invention, a preferred embodiment will now be described, by way of example only and not in any limitative sense, with reference to the accompanying drawings, in which.

BEST MODE FOR CARRYING OUT THE INVENTION

Figure 1:
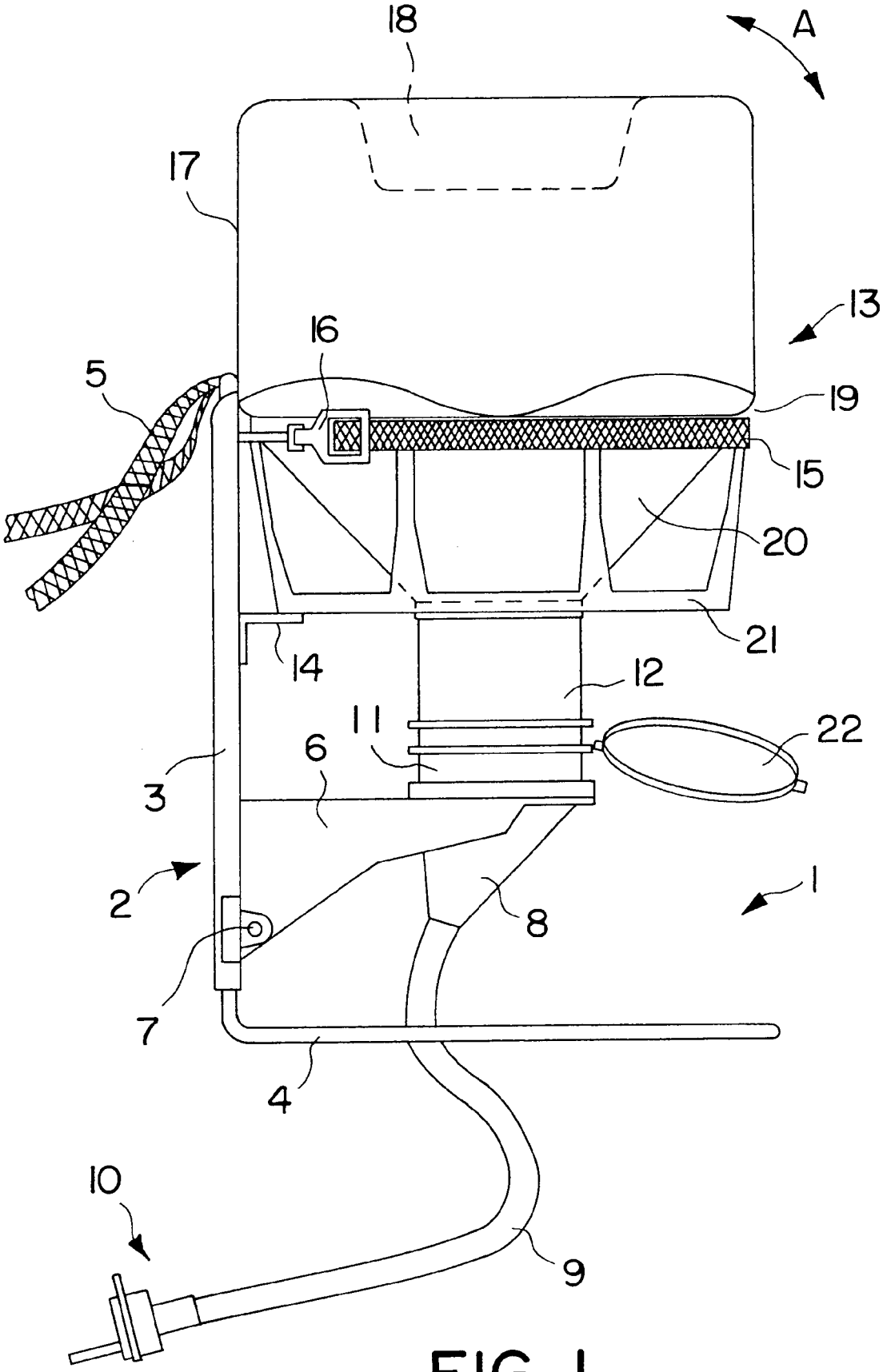
FIG. 1 is an elevational view of a portable dispenser embodying the present invention.

Referring in detail to FIG. 1, a backpack applicator 1 has a carrying frame 2 comprising a generally planar backplate 3 of suitable plastics material such as polycarbonate or metal, and a stand portion 4 extending generally at right angles to the backplate 3. The stand portion 4 is of a tubular metal construction and enables the carrying frame 2 to stand in an upright position when not being carried by a user, as well as permitting easy access to components on the underside of the applicator 1.

A pair of carrying straps 5 (which are only partly shown in FIG. 1) are attached to the carrying frame 2 to enable the applicator 1 to be mounted to a user's back to enable carrying thereof.

A support bracket 6 of metal or other suitable rigid material is pivotably mounted to the carrying frame 2 by means of hinge 7 and is attached to an inlet comprising an inlet funnel 8 of a material such as metal or plastics so as to be generally inert with respect to material to be dispensed from the applicator. A flexible hose 9 extends from a lower portion of the funnel 8, and a dispenser outlet 10, the function of which will be described in detail below, is mounted to the distal end of the hose 9.

The inlet also comprises a generally cylindrical connector 11 rigidly mounted to the funnel 8 for sealable engagement with a generally cylindrical valve 12 of a container 13 of flowable material, such as granular agricultural chemicals. The valve 12 is rotatable relative to the connector 11 between an open position in which flowable material can flow from the container 13 into the funnel 8, and a closed position in which such flow is prevented. It will be appreciated by persons skilled in the art that a variety of valve arrangements can be employed to this end, but a bayonet type valve device as disclosed in European Patent Application No. 0 685 155 is particularly suitable. Alternatively, a valve device as disclosed in European Patent Application No. 0 389 919 may be used.

An L-shaped support bracket 14 of metal is rigidly attached to the backplate 3 of the carrying frame 2 and supports an upper portion of the container 13. The container 13 is held in the position shown in FIG. 1 by means of a restraining strap 15 having a quickly releasable toggle type fastener 16.

The container 13 comprises a generally cylindrical reservoir 17 for containing flowable material and having a recess 18 in the upper face thereof as shown in FIG. 1 to accommodate a valve 12 of an adjacent container 13 when a plurality of such containers 13 are stacked for storage purposes. A shoulder portion 19 provides a region of reduced diameter for locating the restraining strap 15, and a generally frusto-conical portion 20 of the container 13 extends from the shoulder portion 19 to the cylindrical valve 12. The frusto-conical portion 20 is surrounded by a generally cylindrical cage 21 which rests on the support bracket 14 and enables the container 13 to be carried and/or manipulated and takes a substantial proportion of the weight of an adjacent container 13 when a plurality of such containers are stacked for storage purposes with the valves 12 arranged upwardly and the valve 12 of a container received within the recess 18 of an adjacent container 13. A closure cap 22 is attached to the upper end of the connector 11 to prevent ingress of undesirable foreign matter when no container 13 is mounted to the applicator 1.

The function of the applicator 1 shown in FIG. 1 will now be described.

When no container is mounted to the applicator 1, the support bracket 6 pivots downwardly about hinge 7 under its own weight. As a result, the inlet of connector 11 faces away from the backplate 3 of the carrying frame 2 to allow easy access to the connector 11. The closure cap 22 of the connector 11 is then removed and the container inverted so that the valve 12 thereof can engage the connector 11 of the applicator 1. At this stage, the valve 12 of the container 13 is in its closed position so that material cannot flow into the funnel 8. The container 13 is then rotated relative to the connector 11 until the valve 12 reaches its open position to allow material to flow into the funnel 8 under gravity and subsequently into the hose 9 towards the dispenser outlet 10.

The container 13 together with the funnel 8 and support bracket 6 are then pivoted upwardly about hinge 7 in the direction of arrow A in FIG. 1 until the container 13 is in the upright orientation shown in FIG. 1 and the cage 21 thereof is supported on support bracket 14. The restraining strap 15 is then passed around the shoulder portion 19 of the container and the fastener 16 secured so that the container 13 is secured in the orientation shown in FIG. 1. In this position, a substantial portion of the weight of the container 13 is supported on support bracket 14 via cage 21, while that proportion of the weight acting downwardly on support bracket 6 through valve 12 consists substantially of vertical compressional forces and any torsional or shear forces act on the valve 12 are minimized, thus in turn minimizing the risk of damage thereto.

The applicator 1 can then be used in a manner well known to persons skilled in the art in which the user carries the applicator 1 and directs the dispenser outlet 10 to dispense therefrom either dosed quantities of flowable material, or a continuous flow of material, application of which can then be controlled by means of adjustment of the flow rate and/or the walking speed of the user.

Figure 2:
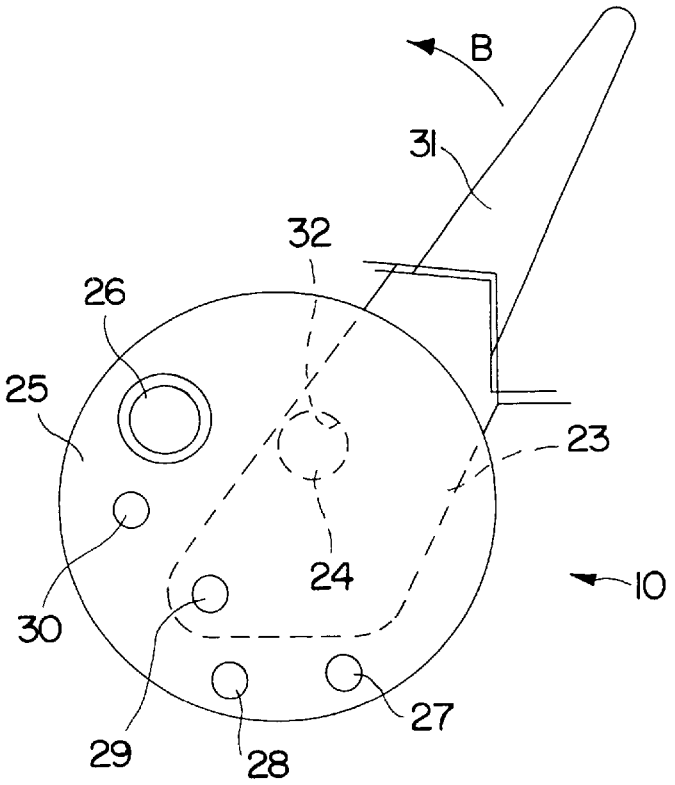
FIG. 2 is a front elevational view of a first embodiment of the dispenser outlet of FIG. 1.

Referring to FIG. 2 which shows a front elevation view of the dispenser outlet 10 of FIG. 1, the dispenser outlet 10 comprises a backplate 23 attached to the distal end of flexible hose 9 and having an input port 24 therein communicating with the funnel 8 of the applicator 1 via the hose 9. A front plate 25 has an output port 26 therein which is angularly offset relative to the input port 24. The front plate 25 is mounted to the backplate 23 by means of screws 27 to 30 and is spaced apart therefrom by a spacer (not shown).

A dispensing lever 31 of similar thickness to the spacer is arranged between the backplate 23 and front plate 25 and has an aperture 32 therethrough such that the aperture 32 defines a chamber between the backplate 23 and front plate 25. The lever 31 is pivotable in the direction of arrow B shown in FIG. 2 about screw 29 between a first position as shown in the figure, in which the aperture 32 is in communication with the inlet port 24, and a second position in which the upper edge of the lever 31 shown in FIG. 2 abuts against screw 30 such that the aperture 32 is in communication with the outlet port 26.

To operate the dispenser outlet 10, the user firstly locates the lever 31 in the position shown in FIG. 2 such that the chamber therein defined by aperture 32 can be filled with flowable material from the applicator 1 via inlet port 24. The volume of the chamber in the lever 31 can be adjusted by a number of means appreciated by persons skilled in the art, such as providing a plurality of interchangeable levers 31 of varying thickness, by reducing the diameter of aperture 32 by means of inserts (not shown), or by providing aperture 32 in the form of an adjustable orifice, i.e. an orifice having variable diameter. The lever 31 is then rotated in the direction of arrow B until the aperture 32 communicates with the outlet port 26 to dispense a desired quantity of flowable material therefrom corresponding to the volume of the aperture.

Figure 3:
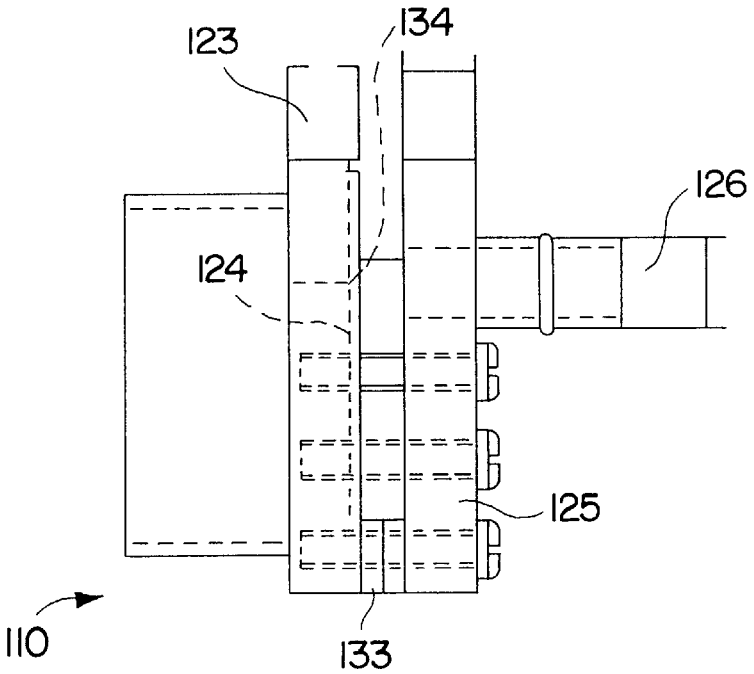
FIG. 3 is a cross sectional elevational view of a second embodiment of the dispenser outlet of FIG. 1 with the lever thereof removed.

Referring to FIG. 3, in which parts common to the embodiment of FIG. 2 are denoted by like reference numerals but increased by 100, the dispenser outlet 110 of an alternative embodiment has a backplate 123 connected to flexible hose 9 and a front plate 125 mounted to the backplate 123 and spaced apart therefrom by a spacer 133.

The backplate 123 has a converging input port 124, the inner end 134 of which is arranged opposite output port 126 in front plate 125 such that there is a degree of alignment between the input 124 and output 126 ports. The lever (not shown) is of identical construction to the lever 31 of FIG. 32 such that when the aperture 32 therethrough is aligned with the input and output ports, flowable material can pass continuously from the input port 124 to the output port 126.

The dispenser outlet 10 can be provided with interchangeable front plates 25,125 such that the embodiment of FIG. 2 can be readily converted to that of FIG. 3.

It will be appreciated by persons skilled in the art that the above embodiment has been described by way of example only and not in any limitative sense, and that various alterations and modifications are possible without departure from the scope of the invention as defined by the appended claims.

What is claimed is:

1. A portable applicator for dispensing flowable material from a container, the applicator comprising:

(a) a carrying frame forwearing by a user and for supporting a container such that a valve of the container faces substantially downwardly;

(b) an inlet mounted to said carrying frame for sealable engagement with said valve of a container for receiving material from the container when the valve thereof is in an open condition thereof;

(c) a dispenser outlet communicating with said inlet for dispensing material received via said inlet; and (d) a support portion for supporting the inlet, said support portion comprising a support bracket connected to said inlet and pivotally mounted to said carrying frame.

2. An applicator according to claim 1, further comprising a stand portion for enabling the applicator to stand upright when not worn by a user.

3. An applicator according to claim 1, further comprising a support portion for supporting the container in use.

4. An applicator according to claim 3, wherein said support portion for supporting the container in use comprises a support bracket mounted to an upright portion of the carrying frame.

5. A portable applicator for dispensing flowable material from a container, the applicator comprising:

(a) a carrying frame for wearing by a user and for supporting a container such that a valve of the container faces substantially downwardly;

(b) an inlet mounted to said carrying frame for sealable engagement with said valve of a container for receiving material from the container when the valve thereof is in an open condition thereof;

(c) a dispenser outlet communicating with said inlet for dispensing material received via said inlet;

(d) a support portion for supporting the inlet, said support portion comprising a support bracket connected to said inlet and pivotally mounted to said carrying frame; and (e) restraining means for restraining pivotal movement of said support bracket relative to said carrying frame in use.

6. A portable applicator for dispensing flowable material from a container, the applicator comprising:

(a) a carrying frame forwearing by a user and for supporting a container such that a valve of the container faces substantially downwardly;

(b) an inlet mounted to said carrying frame for sealable engagement with said valve of a container for receiving material from the container when the valve thereof is in an open condition thereof;

(c) a dispenser outlet communicating with said inlet for dispensing material received via said inlet;

(d) a support portion for supporting the inlet, said support portion comprising a support bracket connected to said inlet and pivotally mounted to said carrying frame; and (e) restraining means for restraining pivotal movement of said support bracket relative to said carrying frame in use, wherein said restraining means comprises a strap for mounting a container in position against the carrying frame.

7. A portable applicator for dispensing flowable material from a container, the applicator comprising:

(a) a carrying frame for wearing by a user and for supporting a container such that a valve of the container faces substantially downwardly;

(b) an inlet mounted to said carrying frame for sealable engagement with said valve of a container for receiving material from the container when the valve thereof is in an open condition thereof;

(c) a dispenser outlet communicating with said inlet for dispensing material received via said inlet; and (d) a container comprising at least one of said valve having an open condition in which material can pass from the container into the inlet and a closed condition in which the valve is sealed, wherein the valve is in its open condition when the container is mounted to the inlet and in its closed condition when the container is disengaged from the inlet.

8. A portable applicator for dispensing flowable material from a container, the applicator comprising:

(a) a carrying frame for wearing by a user and for supporting a container such that a valve of the container faces substantially downwardly;

(b) an inlet mounted to said carrying frame for sealable engagement with said valve of a container for receiving material from the container when the valve thereof is in an open condition thereof;

(c) a dispenser outlet communicating with said inlet for dispensing material received via said inlet; and (d) a container comprising at least one of said valve having an open condition in which material can pass from the container into the inlet and a closed condition in which the valve is sealed, wherein the valve is in its open condition when the container is mounted to the inlet and in its closed condition when the container is disengaged from the inlet, and wherein said container comprises a first valve, and a second valve communicating therewith such that movement of the first valve between its open and closed conditions causes movement of the second valve between its open and closed conditions to enable flow of material through said first and second valves.

9. A portable applicator for dispensing flowable material from a container, the applicator comprising:

(a) a carrying frame for wearing by a user and for supporting a container such that a valve of the container faces substantially downwardly;

(b) an inlet mounted to said carrying frame for sealable engagement with said valve of a container for receiving material from the container when the valve thereof is in an open condition thereof;

(c) a dispenser outlet communicating with said inlet for dispensing material received via said inlet, said dispenser outlet comprising:

(i) an input port for communication with a container of flowable material;

(ii) an output port for dispensing flowable material therefrom; and (iii) a dispensing lever having a chamber therein for receiving flowable material, wherein the lever is movable between a first position in which said chamber is in communication with the output port to enable a quantity of flowable material to be dispensed therefrom and a second position in which said material is prevented from being dispensed from the output port; and (d) a support portion for supporting the inlet, said support portion comprising a support bracket connected to said inlet and pivotally mounted to said carrying frame.

10. A portable applicator for dispensing flowable material from a container, the applicator comprising:

(a) a carrying frame for wearing by a user and for supporting a container such that a valve of the container faces substantially downwardly;

(b) an inlet mounted to said carrying frame for sealable engagement with said valve of a container for receiving material from the container when the valve thereof is in an open condition thereof; and (c) a dispenser outlet communicating with said inlet for dispensing material received via said inlet, said dispenser outlet comprising:

(i) an input port for communication with a container of flowable material;

(ii) an output port for dispensing flowable material therefrom; and (iii) a dispensing lever having a chamber therein for receiving flowable material, wherein the lever is movable between a first position in which said chamber is in communication with the output port to enable a quantity of flowable material to be dispensed therefrom and a second position in which said material is prevented from being dispensed from the output port, wherein said inlet and outlet ports are not aligned and said chamber communicates with said inlet port when the lever is in said second position.

11. A portable applicator for dispensing flowable material from a container, the applicator comprising:

(a) a carrying frame for wearing by a user and for supporting a container such that a valve of the container faces substantially downwardly;

(b) an inlet mounted to said carrying frame for sealable engagement with said valve of a container for receiving material from the container when the valve thereof is in an open condition thereof; and (c) a dispenser outlet communicating with said inlet for dispensing material received via said inlet, said dispenser outlet comprising:

(i) an input port for communication with a container of flowable material;

(ii) an output port for dispensing flowable material therefrom; and (iii) a dispensing lever having a chamber therein for receiving flowable material, wherein the lever is movable between a first position in which said chamber is in communication with the output port to enable a quantity of flowable material to be dispensed therefrom and a second position in which said material is prevented from being dispensed from the output port, wherein said inlet and outlet ports are substantially aligned and material can flow continuously from said inlet port to said outlet port when the lever is in said first position.

12. A portable applicator for dispensing flowable material from a container, the applicator comprising:

(a) a carrying frame for wearing by a user and for supporting a container such that a valve of the container faces substantially downwardly;

(b) an inlet mounted to said carrying frame for sealable engagement with said valve of a container for receiving material from the container when the valve thereof is in an open condition thereof;

(c) a dispenser outlet communicating with said inlet for dispensing material received via said inlet, said dispenser outlet comprising:

(i) an input port for communication with a container of flowable material;

(ii) an output port for dispensing flowable material therefrom; and (iii) a dispensing lever having a chamber therein for receiving flowable material, wherein the lever is movable between a first position in which said chamber is in communication with the output port to enable a quantity of flowable material to be dispensed therefrom and a second position in which said material is prevented from being dispensed from the output port; and (d) said dispensing outlet further comprising means for adjusting the volume of said chamber.

13. A portable applicator for dispensing flowable material from a container, the applicator comprising:

(a) a carrying frame forwearing by a user and for supporting a container such that a valve of the container faces substantially downwardly;

(b) an inlet mounted to said carrying frame for sealable engagement with said valve of a container for receiving material from the container when the valve thereof is in an open condition thereof;

(c) a dispenser outlet communicating with said inlet for dispensing material received via said inlet, said dispenser outlet comprising:

(i) an input port for communication with a container of flowable material;

(ii) an output port for dispensing flowable material therefrom; and (iii) a dispensing lever having a chamber therein for receiving flowable material, wherein the lever is movable between a first position in which said chamber is in communication with the output port to enable a quantity of flowable material to be dispensed therefrom and a second position in which said material is prevented from being dispensed from the output port; and (d) said dispensing outlet further comprising means for adjusting the volume of said chamber, said volume adjusting means comprising a plurality of inserts adapted to be received in the chamber for reducing the volume thereof.

14. A portable applicator for dispensing flowable material from a container, the applicator comprising:

(a) a carrying frame for wearing by a user and for supporting a container such that a valve of the container faces substantially downwardly;

(b) an inlet mounted to said carrying frame for sealable engagement with said valve of a container for receiving material from the container when the valve thereof is in an open condition thereof;

(c) a dispenser outlet communicating with said inlet for dispensing material received via said inlet, said dispenser outlet comprising:

(i) an input port for communication with a container of flowable material;

(ii) an output port for dispensing flowable material therefrom; and (iii) a dispensing lever having a chamber therein for receiving flowable material, wherein the lever is movable between a first position in which said chamber is in communication with the output port to enable a quantity of flowable material to be dispensed therefrom and a second position in which said material is prevented from being dispensed from the output port; and (d) said dispensing outlet further comprising means for adjusting the volume of said chamber, wherein the volume adjusting means comprises a plurality of said levers of different thicknesses, wherein the levers are interchangeably mountable to the outlet.

15. A dispenser outlet for dispensing flowable material, the outlet comprising:

(a) an applicator wherein said support portion comprises a support bracket connected to said inlet and pivotally mounted to said carrying frame;

(b) an input port for communication with a container of flowable material;

(c) an output port for dispensing flowable material therefrom;

(d) a dispensing lever having a chamber therein for receiving flowable material, wherein the lever is movable between a first position in which said chamber is in communication with the output port to enable a quantity of flowable material to be dispensed therefrom and a second position in which said material is prevented from being dispensed from the output port; and (e) wherein said inlet and outlet ports are not aligned and said chamber communicates with said inlet port when the lever is in said second position.

16. A dispenser outlet for dispensing flowable material, the outlet comprising:

(a) an applicator wherein said support portion comprises a support bracket connected to said inlet and pivotally mounted to said carrying frame;

(b) an input port for communication with a container of flowable material;

(c) an output port for dispensing flowable material therefrom;

(d) a dispensing lever having a chamber therein for receiving flowable material, wherein the lever is movable between a first position in which said chamber is in communication with the output port to enable a quantity of flowable material to be dispensed therefrom and a second position in which said material is prevented from being dispensed from the output port; and (e) means for adjusting the volume of said chamber.

17. A dispenser outlet for dispensing flowable material, the outlet comprising:

(a) an applicator wherein said support portion comprises a support bracket connected to said inlet and pivotally mounted to said carrying frame;

(b) an input port for communication with a container of flowable material;

(c) an output port for dispensing flowable material therefrom;

(d) a dispensing lever having a chamber therein for receiving flowable material, wherein the lever is movable between a first position in which said chamber is in communication with the output port to enable a quantity of flowable material to be dispensed therefrom and a second position in which said material is prevented from being dispensed from the output port; and (e) means for adjusting the volume of said chamber wherein said volume adjusting means comprises a plurality of inserts adapted to be received in the chamber for reducing the volume thereof.

18. A dispenser outlet for dispensing flowable material, the outlet comprising:

(a) an applicator wherein said support portion comprises a support bracket connected to said inlet and pivotally mounted to said carrying frame;

(b) an input port for communication with a container of flowable material;

(c) an output port for dispensing flowable material therefrom;

(d) a dispensing lever having a chamber therein for receiving flowable material, wherein the lever is movable between a first position in which said chamber is in communication with the output port to enable a quantity of flowable material to be dispensed therefrom and a second position in which said material is prevented from being dispensed from the output port; and (e) means for adjusting the volume of said chamber wherein said volume adjusting means comprises a plurality of said levers of different thicknesses and wherein the levers are interchangeably mountable to the outlet.

* * * * *